United States Patent [19]

Manson et al.

[11] Patent Number: 5,074,003

[45] Date of Patent: Dec. 24, 1991

[54] AUTOMATIC WASHER WITH CONTROLLED STROKE PARAMETER

[75] Inventors: Larry J. Manson, Baroda Township, Berrien County; Michael D. Goslee, St. Joseph Township, Berrien County; Paul R. Staun, St. Joseph; Bob A. Taylor, Lincoln Township, Berrien County, all of Mich.

[73] Assignee: Whirlpool Corporation, Benton Harbor, Mich.

[21] Appl. No.: 405,219

[22] Filed: Sep. 11, 1989

[51] Int. Cl.[5] ..... D06F 33/02

[52] U.S. Cl. ..... 8/159; 68/12.04; 68/12.05; 68/12.21

[58] Field of Search ..... 68/12 R, 207, 12.02, 68/12.04, 12.05, 12.16, 12.19, 12.21; 8/158, 157

[56] References Cited

U.S. PATENT DOCUMENTS

| | | | |
|---|---|---|---|
| 3,283,547 | 11/1966 | Severance | 68/12 R |
| 3,285,275 | 11/1966 | Couffer, Jr. et al. | 68/12 R |
| 3,381,503 | 5/1968 | Beck . | |
| 3,478,373 | 11/1969 | McBride et al. | 68/12 R |
| 3,497,884 | 3/1970 | Tichy et al. | 68/12 R |
| 3,498,090 | 3/1970 | Mason | 68/12 R |
| 3,503,228 | 3/1970 | Lake . | |
| 3,589,148 | 6/1971 | Waseman | 68/12 R |
| 3,648,487 | 3/1972 | Hoffman . | |
| 3,673,823 | 7/1972 | Gakhar | 68/12 R |
| 4,303,406 | 12/1981 | Ross | 68/12 R |
| 4,335,592 | 6/1982 | Torita | 68/12 R |

FOREIGN PATENT DOCUMENTS

| | | | |
|---|---|---|---|
| 59-6098 | 1/1984 | Japan | 68/207 |
| 61-191393 | 8/1986 | Japan . | |
| 62-64397 | 3/1987 | Japan | 68/12 R |

OTHER PUBLICATIONS

Unitrode Corporation Applications Handbook 1985–1986.

*Primary Examiner*—Frankie L. Stinson

[57] ABSTRACT

An automatic washer is provided which includes a control for automatically operating an agitator drive motor at a speed or other parameter of agitator operation, dependent upon a selected liquid level for the wash cycle. Such an arrangement results in a uniform wash action at varying wash liquid levels.

21 Claims, 13 Drawing Sheets

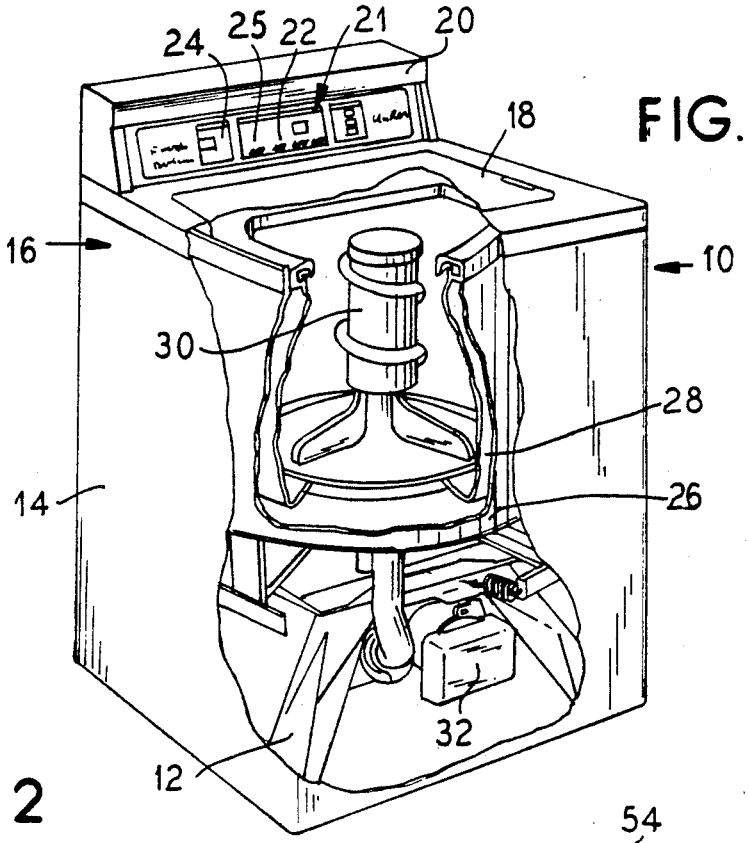
FIG. 1
FIG. 2
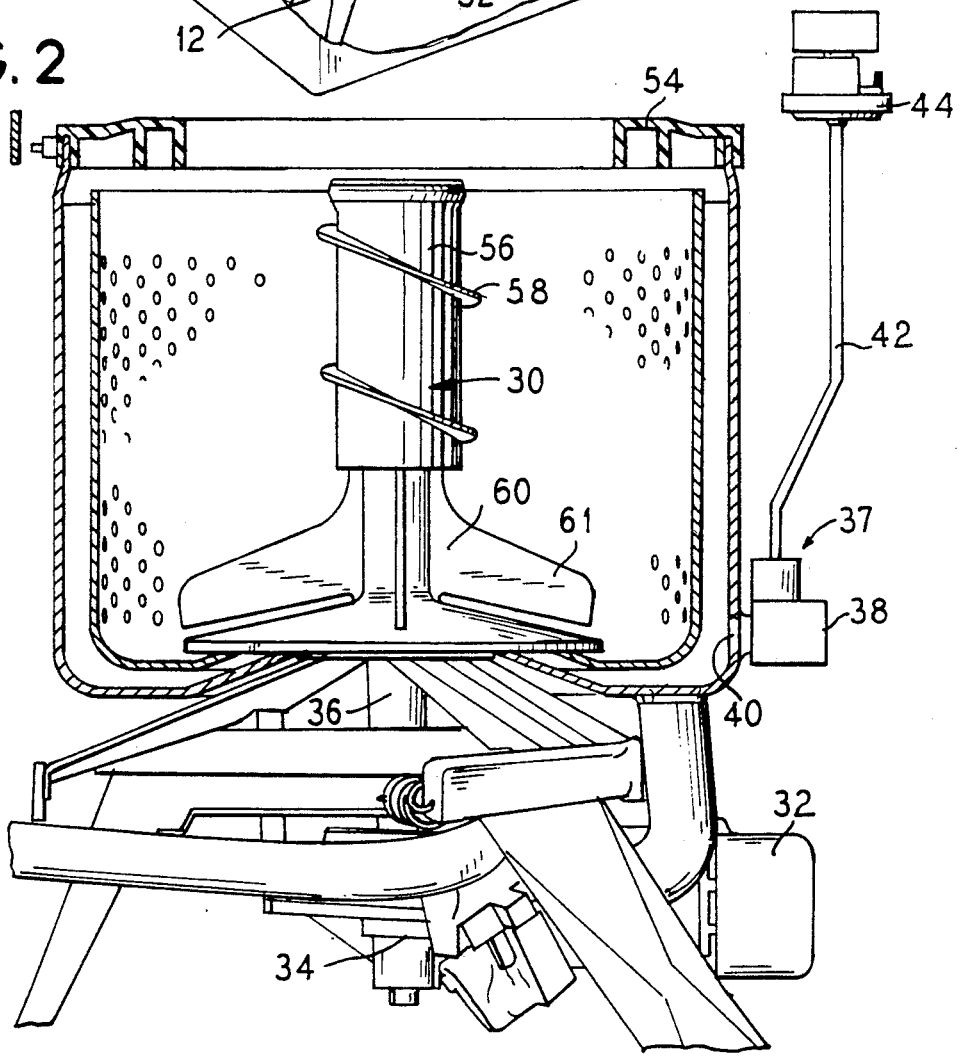

FIG. 4A

| CYCLE / WATER LEVEL | COTTON | STURDY PRESS | PERM. PRESS | KNITS | DELICATE | HAND WASH |
|---|---|---|---|---|---|---|
| FULL | 180 | 180 | 155 | 155 | 120 | 90 |
| MEDIUM HIGH | 180 | 180 | 155 | 155 | 120 | 90 |
| MEDIUM | 155 | 155 | 135 | 135 | 120 | 90 |
| MEDIUM LOW | 155 | 155 | 135 | 135 | 90 | 60 |
| LOW | 135 | 135 | 120 | 120 | 90 | 60 |

FIG. 4B

| CYCLE / WATER LEVEL | COTTON | STURDY PRESS | PERM. PRESS | KNITS | DELICATE | HAND WASH |
|---|---|---|---|---|---|---|
| FULL | 180 | 155 | 135 | 120 | 90 | 60 |
| MEDIUM HIGH | 180 | 155 | 135 | 120 | 90 | 60 |
| MEDIUM | 155 | 135 | 120 | 90 | 90 | 60 |
| MEDIUM LOW | 155 | 135 | 120 | 90 | 60 | 40 |
| LOW | 135 | 120 | 90 | 60 | 60 | 40 |

COMMAND INTEGRATOR
SET BACK INTEGRATOR
PEAK DETECTOR
SUMMING AMP.
REF BUFFER
CURRENT SENSE AMP.
P8
P4
90
99
100
101
102
103
109
110
111
112
114
115
116
117
118
119
122
124
126
129
N.C.
VZ
+12V
U1
U2
U3
U4
VR1
R1
R2
R3
R6
R7
R9
R10
R11
R13
R14
R15
R16
R17
R19
R21
R23
R25
R26
R27
R28
R29
R30
R31
R32
R34
R36
R37
R38
R39
R41
R42
R43
R44
R45
R5
R53
R54
C1
C2
C6
C7
C13
C15
C17
C18
C23
C24
C25
C26
C27
C28
C29
C30
C31
C32
C33
C37
D1
D3
D4
D5
D7
D13
D19
D20

D9
D12
D18
D2
T2
D10
C35
R22
L1
C3
C12
C36
R49
+12V
C11
C34
32
P7
L5
MOTOR L
MOTOR R
P6
BACK EMF AMP.
U3
R52
R47
C9
R46
R48
C8
106
105
D11
C4
R51
K1
C5
RV1
SPIN
P1
P3
P5
R50
117
P4
D8
HEAT SINK
L2
P10
R55
+12V
R20
C19
C21
C16
120
T1
136
E14
108
Q3
D15
R4
138
119
Q1
D14
140
C14
+12V
C10
D16
R40
Q2
130
R18
134
D6
R33
04
D17
C22
128
132

KEY MATRIX

| | C0 | C1 | C2 | C3 | C4 | C5 | C6 | C7 |
|---|---|---|---|---|---|---|---|---|
| K0 | LO-SPEED SPIN | EXTRA RINSE | WARM RINSE | STOP | + | START | | |
| K1 | SIGNAL UP | SIGNAL DOWN | WASH TEMP. UP | WASH TEMP. DOWN | WASH TIME UP | WASH TIME DOWN | WATER LEVEL UP | WATER LEVEL DOWN |

FIG. 8B

LED MATRIX (ANODE)

| | C0 | C1 | C2 | C3 | C4 | C5 |
|---|---|---|---|---|---|---|
| R0 | COTTON STURDY (GREEN) | STOP (RED) | TEMP. LO (RED) | MSD A (RED) | LSD A (RED) | WATER LOW (RED) |
| R1 | FAVORITE CYCLE (GREEN) | WASH TIME (RED) | TEMP. MEDIUM (RED) | MSD B (RED) | LSD B (RED) | WATER MED. LOW (RED) |
| R2 | PERM'T PRESS (GREEN) | EXTRA RINSE (GREEN) | TEMP HIGH (RED) | MSD C (RED) | LSD C (RED) | WATER MEDIUM (RED) |
| R3 | KNIT (GREEN) | WARM RINSE (GREEN) | SOAKING (YELLOW) | MSD D (RED) | LSD D (RED) | WATER MED. HI (RED) |
| R4 | RINSE SPIN (GREEN) | LO-SPEED SPIN (GREEN) | WASHING YELLOW | MSD E (RED) | LSD E (RED) | WATER HI (RED) |
| R5 | SPIN ONLY (RED) | PRE-SOAK (GREEN) | RINSING (YELLOW) | MSD F (RED) | LSD F (RED) | |
| R6 | START (GREEN) | PRE-WASH (GREEN) | SPINNING (RED) | MSD G (RED) | LSD G (RED) | |
| R7 | DELICATE (GREEN) | HAND WASHABLE (GREEN) | STURDY PRESS (GREEN) | | | |

FIG. 8D

184

| CONNECTOR 1 | |
|---|---|
| PIN DESIGNATION | |
| PIN NO. | SIGNAL NAME |
| 1 | R0 |
| 2 | R1 |
| 3 | R2 |
| 4 | R3 |
| 5 | R4 |
| 6 | R5 |
| 7 | R6 |
| 8 | R7 |
| 9 | C0 |
| 10 | C1 |
| 11 | C2 |
| 12 | C3 |
| 13 | C4 |
| 14 | C5 |
| 15 | C6 |
| 16 | C7 |
| 17 | K1 |
| 18 | K0 |

FIG. 8E

182

| CONNECTOR 2 | |
|---|---|
| PIN DESIGNATION | |
| PIN NO. | SIGNAL NAME |
| 1 | OFF |
| 2 | COMM. |
| 3 | T0 |
| 4 | T1 |
| 5 | T2 |
| 6 | T3 |
| 7 | T4 |
| 8 | T5 |
| 9 | T6 |
| 10 | T7 |
| 11 | T8 |
| 12 | T9 |
| 13 | T10 |

FIG. 8C

TOUCH-TO-START MATRIX

| | T0 | T1 | T2 | T3 | T4 | T5 | T6 | T7 | OFF | T8 | T9 | T10 |
|---|---|---|---|---|---|---|---|---|---|---|---|---|
| COMM. | COTTON STURDY | FAVORITE CYCLE | PERM'T. PRESS | KNIT | PRE-SOAK | PRE-WASH | RINSE SPIN | SPIN ONLY | CANCEL | DELICATE | HAND WASHABLE | STURDY PRESS |

150
F5
D2B
DB1
D21
D30
C37
C35
J
U12
R80
R98
R109
R107
R108
Q5
Q6
R94
R97
D29
D33
C40
P10
J2
P1
P24
P22
P20
R88
R95
R77
R81
D26
D32
E
D
F
G
+12
158
154
160
RJ1
RJ2
RJ3
Q9
Q10
Q8
R62
C31
R70
R72
C32
R74
R85
R93
R67
D35
R69
D23
P37
P32
P36
P31
P35
P34
P33
P39
P38
P40
162
RJ4
RJ5
RJ6
Q11
Q7
Q12
R112
C48
R90
C46
R108
C41
R84
R83
R82
R101
R99
R113
C33
C30
156
C29
C34

AUTOMATIC WASHER WITH CONTROLLED STROKE PARAMETER

BACKGROUND OF THE INVENTION

The present invention relates to automatic washers and more particularly to a control for an automatic washer for controlling a stroke parameter of a vertical axis agitator.

Vertical axis agitators are generally provided with a plurality of radially extending vanes which are oscillated during a wash cycle to cause a toroidal flow of liquid in the wash basket resulting in a continuous turnover of fabric materials within the wash basket. While this type of action increases the washing action, there is a trade-off on the level of such action between increased washing action and increased abrasion and damage to the fabric articles. Many attempts have been made to reduce abrasion and wear of the articles including providing flexible vanes for the agitators and providing controls and transmission mechanisms which provide selected stroke parameters such as stroke rates, stroke angles, or stroke velocity, during a wash cycle. However, such predetermined stroke parameters are not always the optimum stroke parameter for a particular fabric load, but rather may be selected as an optimum for an average load. Thus, any non-average load would be washed with a non-optimum stroke parameter.

SUMMARY OF THE INVENTION

The present invention provides a control for an automatic washer which permits the same wash action to be retained from one liquid or water level selection to another by adjusting various stroke parameters in accordance with this selection. For example, in a preferred embodiment of the invention, each liquid level of every wash cycle has an assigned agitation speed. When a liquid level is selected, the corresponding agitation speed for the selection and that particular cycle will be used once the liquid level is reached.

During the agitation period, if the liquid level selection is increased, the agitation may stop until the new liquid level is reached. Once reached, a new agitation speed will be called for, based on the new liquid level selection. Because the liquid level selection and the agitation speed has increased by a related amount, the clothes load will see the same wash action as in the initial settings.

Not only can a same wash action be retained between liquid levels, but the wash action may even be reduced if desired. Lowering the liquid level selection during agitation will cause a drop in the agitation speed. However, no liquid will be drained from the machine so that the clothes load in the machine will see the same amount of liquid but a lower agitation speed. Thus, a less severe wash action is seen by the clothes load. In this manner, an optimum agitation speed can be preselected for a given clothes load or, a reduced agitation speed can be applied by manual selection by the user once the liquid level in the wash basket has increased to a particular operator selected level.

Various other stroke parameters could be varied in a manner similar to that described above for stroke speed. For example the stroke frequency or the stroke angle, the dwell time between strokes, or the advance or recession of the agitator between strokes, could be varied. Further, various wave forms of stroke speed could be provided by the control, such as sinusoidal, trapezoidal, square, triangular, or arbitrary wave forms. Thus, it is seen that the present invention provides a means for controlling the amount of energy put into the wash load through the agitator by controlling one or more than one stroke parameter of the agitator.

In the preferred embodiment, the agitator stroke parameter is controlled by controlling the speed of the motor of the washing machine. A control is provided for a washing machine motor such that the output speed and direction of rotation of the motor shaft can be controlled.

In the electronic version of the preferred embodiment, a control scans the input key switches to accept commands and to select options. The control activates valves and pumps and monitors the output of a water or liquid pressure sensor which detects the water level within the wash basket. The control may also regulate other functions of the washer such as controlling a speaker and a fluorescent light and monitoring a lid switch. To control the motor speed, the control monitors the speed of the motor, for example by monitoring a hall effect sensor, and sends a signal. The signal has a varying pulse width representing the desired speed including corrections based on the actual speed, the cycle, the time within the cycle, the water level sensed and the water level setting. The control also controls the directional relay on the motor control board in response to the cycle selected and the time within that cycle.

The many objects and advantages of the present invention will become apparent to those skilled in the art when the following detailed description of the preferred embodiments is read in conjunction with the drawings.

BRIEF DESCRIPTION OF THE DRAWINGS

FIG. 1 is a partially cut-away perspective view of an automatic washer having a DC motor and embodying the principles of the present invention.

FIG. 2 is a side cut-away view of an automatic washer of FIG. 1.

FIGS. 4A and 4B are tables illustrating representative stroke speeds for various liquid levels and cycle selections in preliminary and principal portions of the wash cycle, respectively.

FIG. 7 is an elevational view of a control panel for operator input of water level and cycle selection information to the automatic washer of FIG. 1 according to the present invention.

FIGS. 8A, 8B, 8C, 8D and 8E are tables illustrating the electrical pin, key switch, and LED connections between the control panel of FIG. 7 and the electrical components of FIGS. 9A, 9B and 9C.

Figure 5A:
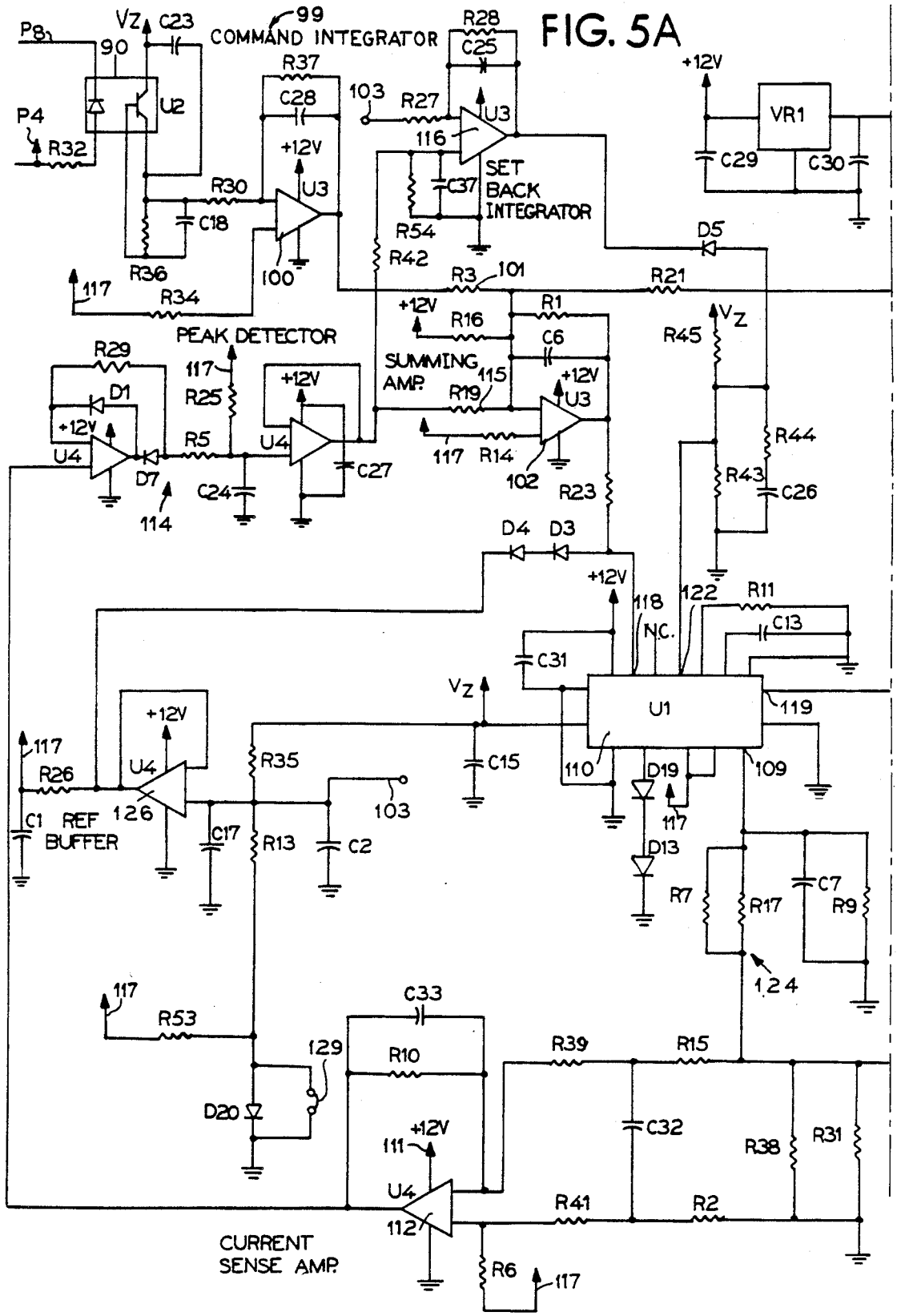
FIGS. 5A and 5B shows an electrical schematic diagram for an electronic motor control for use with the present invention.
Figure 5B:
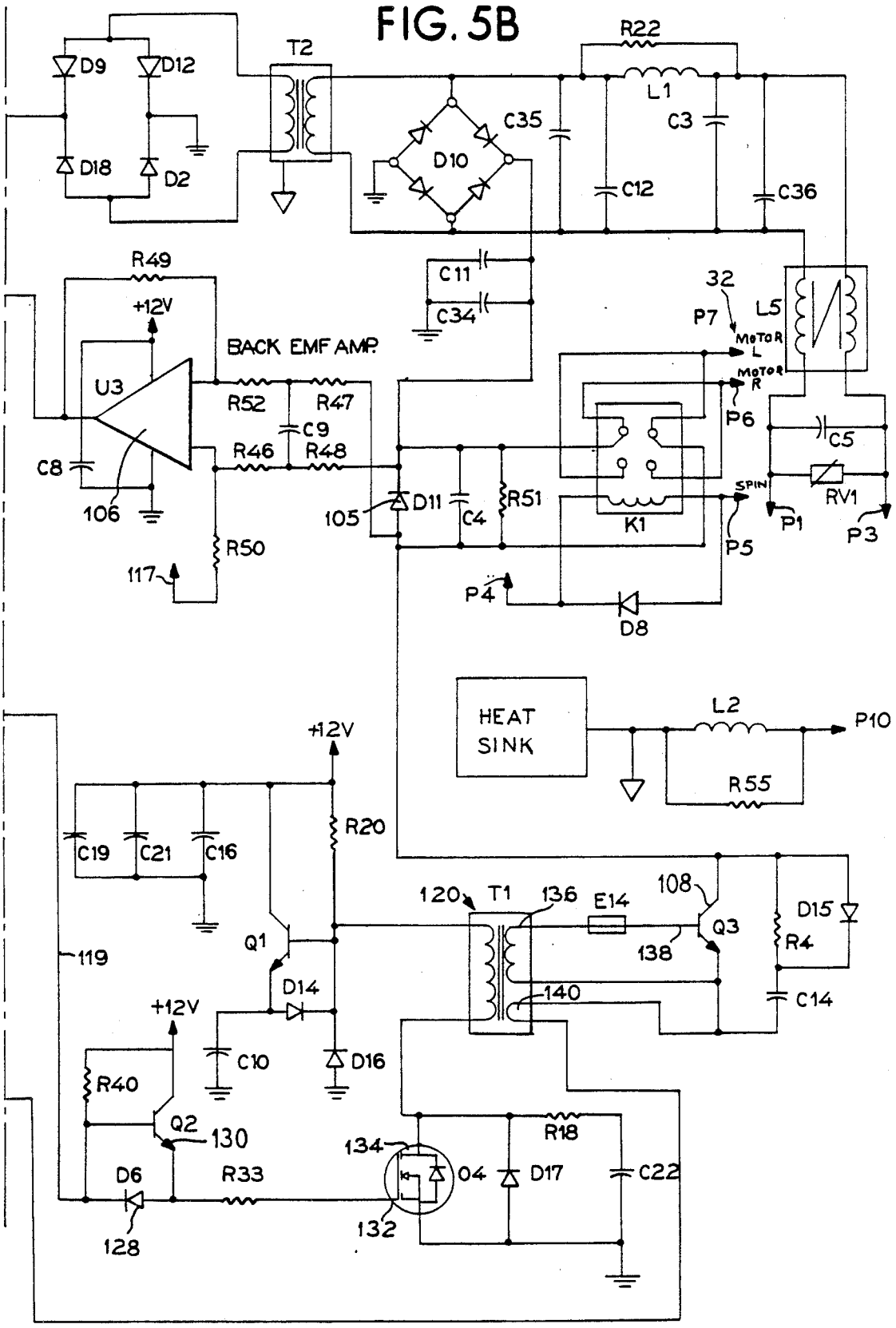
Figures 7, 8A:
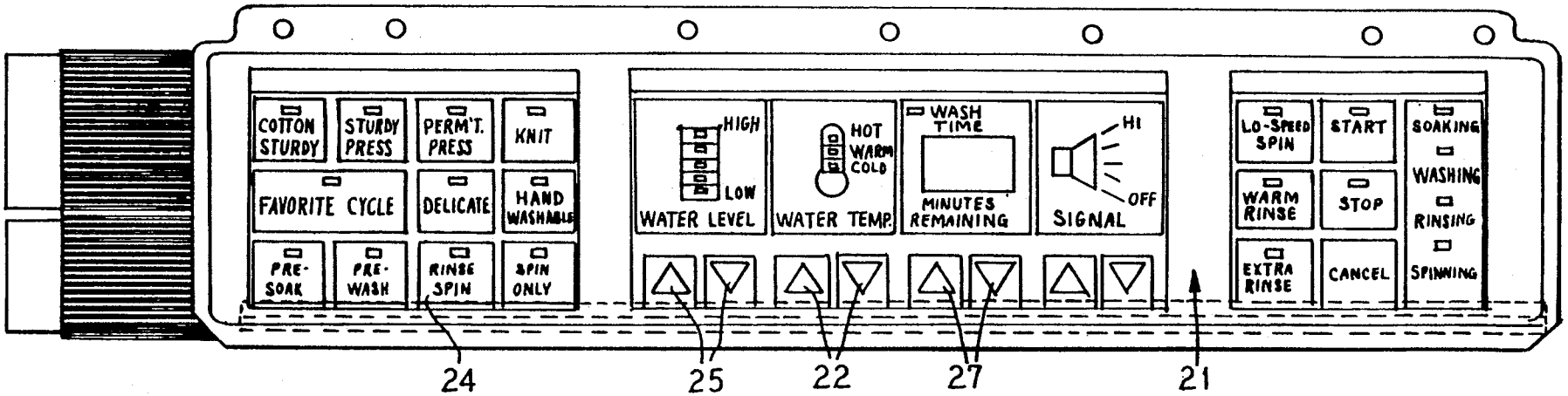

9A, 9B and 9C, the motor control board of FIGS. 5A and 5B and the control panel of FIG. 7 illustrating the electrical interconnections of these components.

Figure 11:
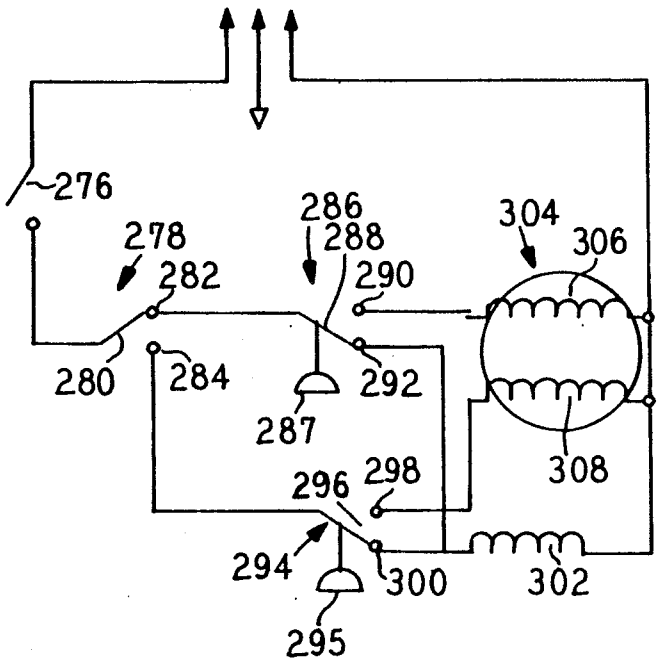

FIG. 11 is an electrical schematic diagram for one embodiment of a mechanical motor speed control based on liquid level for an automatic washer using a multiple pole induction motor.

Figure 12:
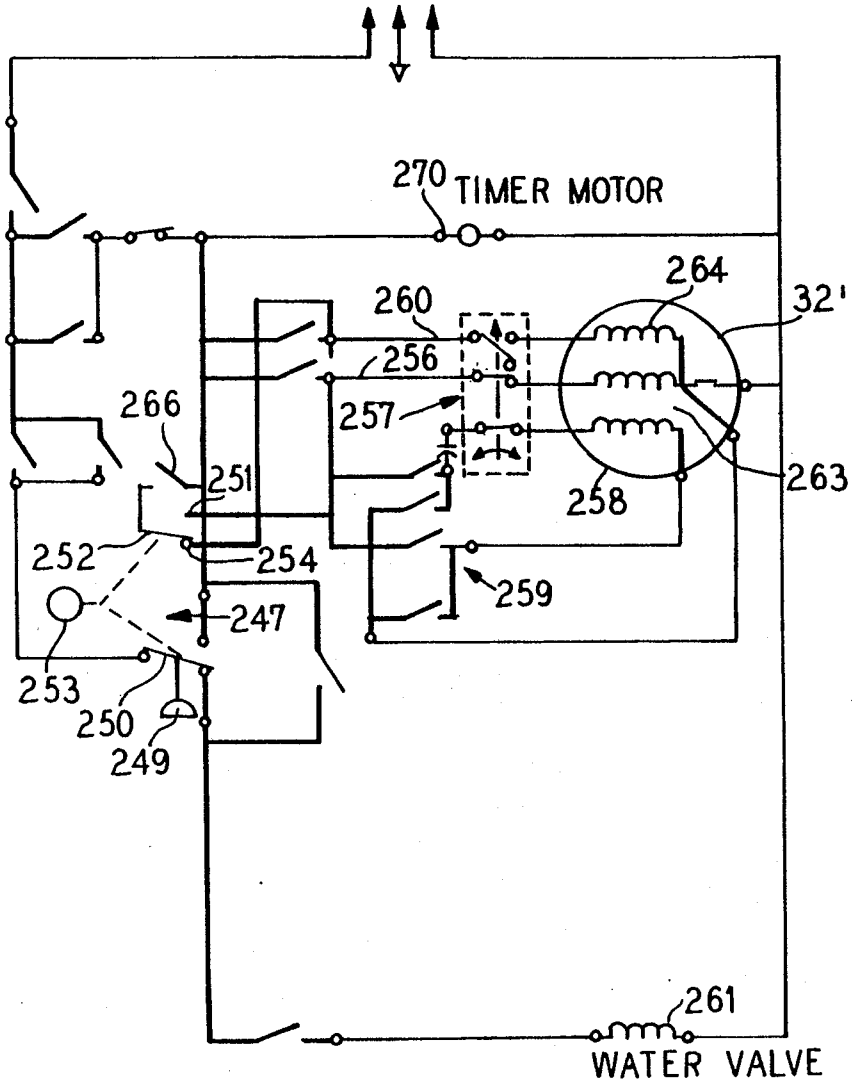

FIG. 12 is an alternative embodiment of a mechanical motor speed control dependent on liquid level for an automatic washer using a multiple pole induction motor.

DESCRIPTION OF THE PREFERRED EMBODIMENTS

In FIG. 1 there is illustrated an automatic washer generally at 10, the washer being a vertical axis agitator type washing machine having presettable controls for automatically operating the machine through a programmed series of washing, rinsing and spinning steps. The machine includes a frame 12, exterior panels 14 forming the sides, top, front and back of a cabinet 16. A hinged lid 18 is provided in the usual manner for access to the interior of the washer 10. As is well known in the art, and therefore not shown in the drawing, a switch may be provided for signalling the opening of the lid.

The washer 10 has a rear console 20 on which is disposed a manually setable control panel, 21, shown in greater detail in FIG. 7. The control panel 21 includes a water temperature selector 22, a cycle selector 24, a time selector 27, and liquid level selector 25 in the form of key pads. It will be appreciated by those skilled in the art that the liquid level selector 25 and cycle selector 24 can alternatively be buttons or knobs to mechanically move a switch contact to a desired position.

Internally of the washing machine 10 there is disposed an imperforate liquid containing wash tub 26 within which is rotatably mounted a perforated basket 28 for rotation about a vertical axis. As best shown in FIG. 2, a vertically disposed agitator 30 is connected for operation to motor 32 through a suitable drive transmission mechanism 34 such as to cause oscillation of the agitator shaft either by mechanical reversing means or by reversing the motor for each agitator cycle as is well known in the art. More particularly the agitator 30 is linked by a shaft 36 through the drive transmission mechanism 34, which may be a reduction drive transmission, which in turn is driven by the motor 32, preferably is a D.C. motor, mounted directly to the drive mechanism 34. A hall effect sensor 104, described later herein, is magnetically coupled to the motor 32 to sense the speed of the motor.

The shaft 36 extends upwardly from the drive mechanism 34 through the bottom of the tub 26 and the perforate basket 28 and connects to the agitator 30.

A liquid level sensor 37 is provided to signal the level of liquid water in the tank. As is well known, the liquid level sensor 37 includes a pressure dome unit 38 is secured to the wash tub 26 and communicates therewith through an opening 40 in the tub wall. An air tube 42 extends up to a pressure sensor unit 44 which converts pressure to a signal representative of liquid level within the tub 26. A tub ring 54 extends around the top of the tub 26. Alternate types of liquid level sensors, as is well known in the art, may be substituted for the dome type selected for the preferred embodiment.

The agitator 30 may be a dual action agitator having an upper barrel 56 with helical vanes 58, as well as a lower agitator portion 60 from which radially extends a plurality of flexible vanes 61. The flexible vanes 61 enable the agitator 30 to absorb energy as the direction of rotation is reversed, while still coupling the agitator 30 to the load provided by liquid within the tub 26 as well as any articles of clothing or fabric therein. Other types of agitator constructions are well known and could similarly be used.

The present invention uses the information obtained from the user input to the cycle selector 24, the water level selector 25, and the time selector 27 as well as the monitored information from the liquid level sensor 37, the hall effect sensor 104, and the lid switch to control the operation of the washer. In particular, the control regulates the agitator speed during the wash cycle in response to the selection of water level and cycle by the user. In the preferred embodiment, the stroke angle is maintained while the speed of the motor is varied, thus varying the stroke rate in response to the control.

Figure 3:
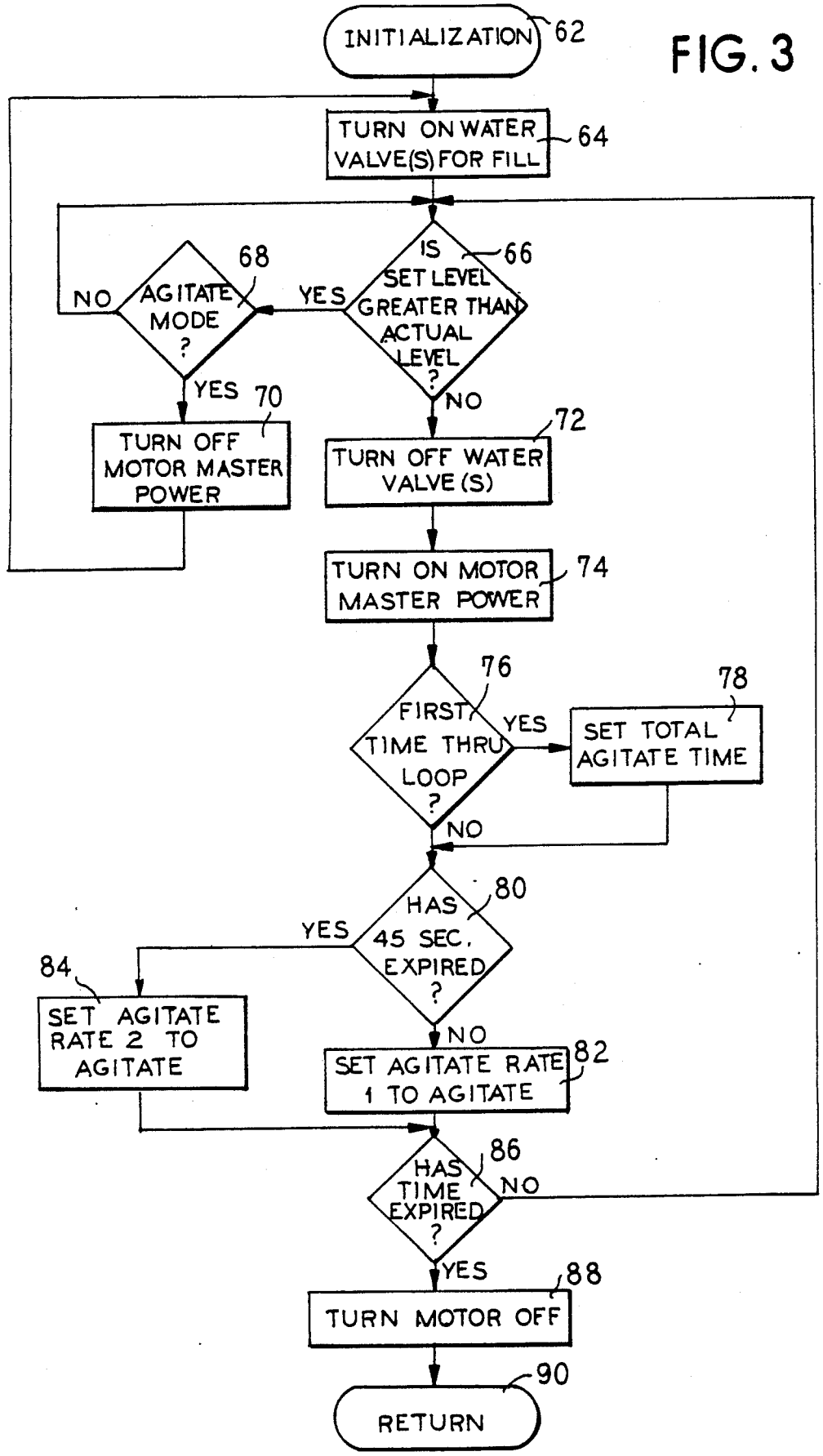
FIG. 3 is a flow chart of steps embodying the principles of the present inventive control.

FIG. 3 is a flow chart diagram for a certain steps relating to the agitate portion of the wash cycle when an electronic control of the present invention is being utilized. A master control, well known in the art and not shown in the drawing, controls the overall operation of the washer 10, providing, for example, spin, drain, dispenser control, temperature control, and user interface. Entry to this mode is achieved through the initialization step 62 where various values such a the selected liquid levels, the selected cycle settings, and the water temperature values are initialized. These settings are made by the user through appropriate operation of selectors 22, 24 and 25 described above.

Next, control passes to control step 64 wherein water valves are controlled to effect the filling of the washer wash tub 26 to the selected value, as is well known in the art. Control next passes to control step 66 which inquires whether the selected water level from selector 25 is greater than the actual water level sensed by the water level sensor 37. If the inquiry answer is yes, then control passes to control step 68 which inquires whether the cycle has moved into the agitate mode, i.e. is the motor currently driving the agitator? If the inquiry answer in control step 68 is no, then control is returned to control step 66 to repeat the water level inquiry. If the inquiry answer in control step 68 is yes, then control first passes to control step 70, which causes the motor master power to be turned off, and then control next passes back to control step 64 to turn on the water valves to initiate a further filling step. This path would be followed if the user were to change the water level selection to a greater level once the washer has already moved into the agitate portion of the wash cycle. This will cause the agitation to terminate until the actual water level within the wash tub has increased to the re-set level.

When the inquiry answer in control step 66 is no, then control passes to control step 72 to turn off the water valves since the negative answer signifies that the actual water level within the tub 26 has reached the set level. It should be noted that this path is followed when the filling operation is complete, but is also followed if the user were to change the water level selection to a lower level once the washer has filled beyond that lower level. This will cause the washer to retain the water which has been added yet retain in the control an indication of a lower water setting. As will be appreciated from the subsequent description of the control, this will result in a less vigorous wash action.

Control passes from control step 72 to control step 74 which causes the motor master power to turn on. Control next passes to control step 76 which inquiries whether this is the first time control has passed through this loop. If the answer to the inquiry in control step 76 is yes, then control passes to control step 78 to set a total agitate time dependent upon the cycle selected by the user from selector 24 as well as the time selected by the user from selector 27. Such time can be selected from a stored table based upon the cycle selection setting, which is increased or decreased by the user time selection setting.

After the total agitate time is set by control step 78 or, if the inquiry answer in control step 76 is no, control then passes to control step 80 which inquiries whether a first predetermined time period, preferably 45 seconds, has expired. If the answer to the inquiry in control step 80 is no, then a first agitate speed is set. This agitate speed corresponding to a certain motor speed, may be looked up in a stored table, for example, where appropriate predetermined stroke speeds have been entered for various combinations of liquid levels and cycles, such as illustrated in FIG. 4A. The first agitate rate is applied for the predetermined time period set in control step 80 and, in most instances, is slightly higher than a normal agitate speed for the given water level and cycle selection, so as to ensure that all of the fabrics within the wash basket are completely wetted prior to the beginning of the normal agitate rate.

Once the initial time period set in control step 80 has passed, the inquiry answer to control step 80 will be yes and control will pass to control step 84 wherein a second agitate rate is set. Again, this agitate rate corresponds to a certain motor speed and may be looked up in a stored table where appropriate predetermined stroke rates have been entered for various combinations of liquid levels and cycles, such as illustrated in FIG. 4B. Thus, it is seen in comparing FIGS. 4A and 4B that if, for example, a sturdy press cycle is selected with a full water level, an initial stroke rate, as illustrated in FIG. 4A, will be 180 strokes per minute while the principal stroke rate for the remainder of the agitate cycle, as seen in FIG. 4B, will be 155 strokes per minute.

It should be noted that the stroke rates of FIGS. 4A and 4B, as well as the preferred predetermined time of 45 seconds for the use of the higher stroke rate was determined experimentally for the particular washer 10 and will vary depending on the size and shape of the basket 28, the design of the agitator 30 and the drive mechanism 34 selected. It should also be noted that the preferred embodiment contemplates modifying the motor speed, yet results in variation of the stroke rate since the drive transmission mechanism 34 maintains a constant stroke angle.

Figure 6:
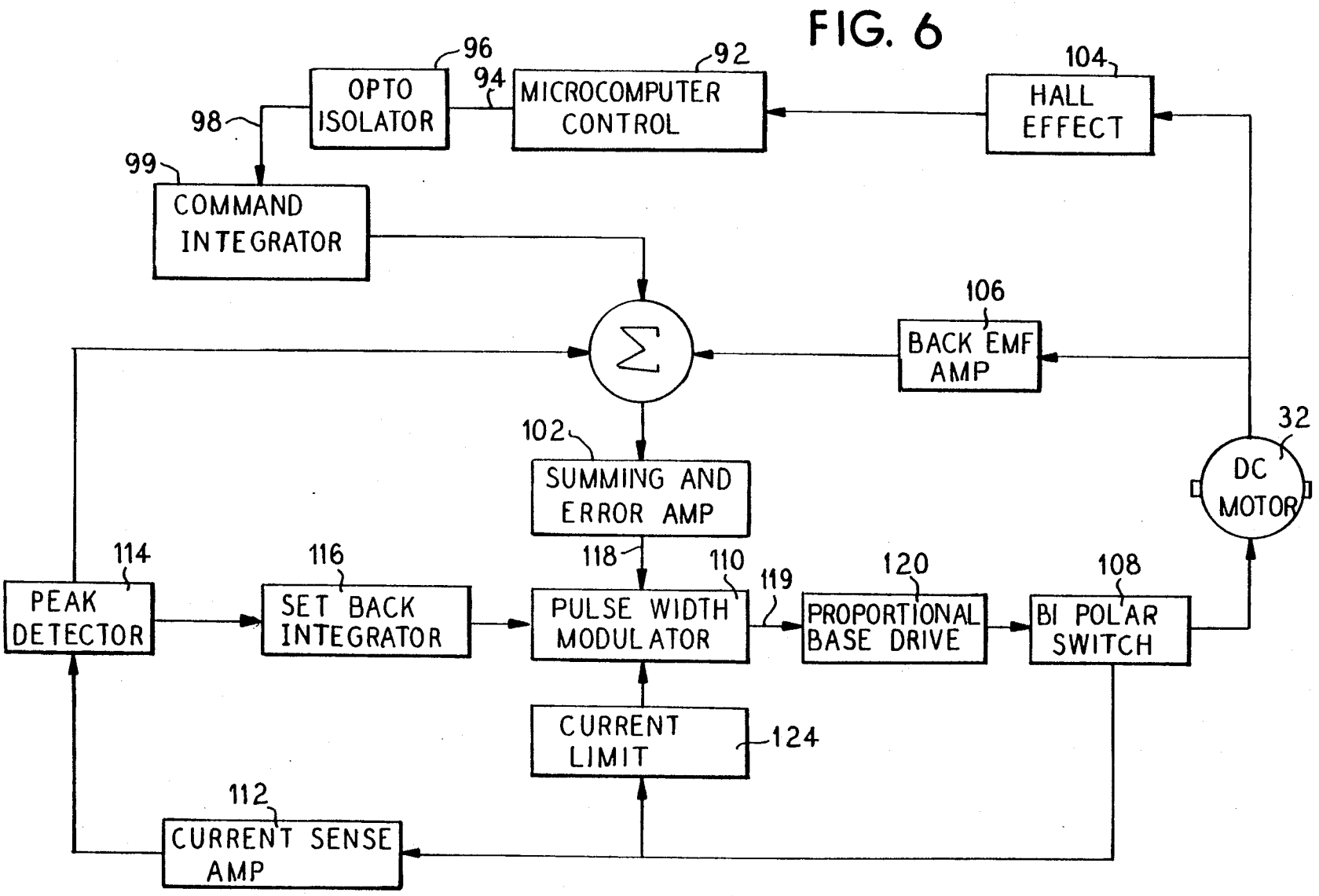
FIG. 6 is an electrical schematic block diagram for an electronic motor control of FIGS. 5A and 5B including the processor board of FIGS. 9A, 9B and 9C illustrating the motor control loop of the present invention.

Referring back to FIG. 3, control steps 82 and 84 communicate to the motor control, as shown in FIGS. 5A, 5B and 6, a pulse width representing the desired motor speed based on the number selected from the tables of FIGS. 4A and 4B and the motor speed detected by the hall effect sensor 104 of FIG. 6, described later. After one or the other of the agitate speeds are set by control steps 82 or 84, control will pass to control step 86 to inquire whether the total agitate time as set by control step 78 has expired. If the answer to the inquiry of control step 86 is no, then control is passed back to control step 66 to recheck the selected water level setting. As is well known in the art, the user may modify this time setting during the cycle. Again, if the user changes the water level setting to a higher level setting during the agitate cycle, this return loop will insure that additional filling of the wash tub occurs. Alternatively, if the user changes the water level setting to a lower level setting, this return loop will eventually pass control to control steps 82 or 88 which may select a lower stroke rate from the stored tables FIGS. 4A and 4B.

Once the inquiry in control step 86 is answered yes, control passes to control step 88 which turns off the motor master power and then control passes to control step 90 which returns control to the master control for further operation of the wash cycle.

FIG. 6 is a schematic block diagram of the motor control (which is shown in greater detail in FIGS. 5A and 5B) which can be utilized to carry out the present invention. A microcomputer control 92 (which is shown in greater detail in FIGS. 9A, 9B and 9C) sends a selected pulse width between 0 and 64 milliseconds along line 94 to an opto isolator 96. The pulse width is proportional to the desired speed for the motor 32.

The output pulses of the opto isolator 96 are sent on line 98 and are integrated in a command integrator 99. As shown in FIG. 5A, the command integrator 99 includes an op amp 100. Another function of the integrator 99 is to provide a soft start of the motor wherein the rate of change of speed is determined by the value of integrator capacitance. The output signal of the op amp 100 goes through a series impedance 101 to the input of a summing amplifier 102. The summing amplifier 102 sums three signals: the command signal from the command integrator 99, the back emf signal from an amplifier 106, and the IR compensation signal from a peak detector 114. This signal is periodically adjusted by the microcomputer 92 based upon the error computed between the hall effect sensor 104 (FIG. 6) which measures the speed of the motor, and the desired speed.

The back EMF of the D.C. motor is sensed across a fly back diode 105, as shown in FIG. 5B and amplified differentially by a back EMF amplifier 106. The signal, which represents an uncorrected motor speed, then passes through the series impedance 101 to the summing amp 102. The sensed voltage across the flyback diode 105 represents $$VS = L\frac{dI}{dt} + R\text{ motor } I + R\text{ wiring } I + Eg,$$

where Eg is the back EMF of the motor and L is the inductance of the motor. If the current is held constant, $$\frac{dI}{dt} = 0,$$

the equation simplifies to Vs=(R motor+R wiring) I+Eg. The peak detection circuit 114, which detects peak current through the bipolar switch 108 compensates via a series impedance 115 so that the sum of the signal through series impedance 115 and the signal through series impedance 101 from the back EMF amplifier 106 represent Eg plus some error. Therefore, the resistance 115 is chosen to compensate for the motor and wiring resistors. The error results because the resistance of the motor and wiring is only compensated for the lowest possible resistance in order to avoid introducing positive feedback into the system. Additionally, $Eg=K_eW$ where $K_e$ is the back EMF constant of the motor and W is the motor's angular velocity. $K_e$ is determined by various factors in the construction of the motor, namely number of turns in the winding, and magnetic field. Therefore, the signal at the summing junction at the input of amplifier 102 represents a corrected speed.

The current flowing through a bipolar switch 108, as shown in FIGS. 5B and 6, is monitored by a current limit pin 109 of a pulse width modulator integrated circuit (PWM-IC) 110. Also, the sensed current is differentially amplified by a current sense amplifier 112 to provide a voltage signal proportional to the current through the bipolar switching as sensed by the parallel combination of $R_{38}$ and $R_{31}$. The voltage signal is sent to a peak detector circuit 114. The peak detection circuitry samples and holds the peak values of the current sensed wave form, representing the average current flowing through the motor 32. This output is sent both to the summing and error amp 102 and a set back integrator 116, to compensate for sudden torque and load changes which would affect the average motor speed and to compensate for the product of the current through and the resistance of the motor 32 and the wiring.

The set back integration circuit 116 operates as a delayed steady state current limit in the event of a long term overload while allowing for temporary peak torque requirements. As the output reaches a steady state value, the duty cycle of the pulse width modulator (integrated circuit 110 is limited to below a maximum value, preventing a steady state motor current overload which might otherwise occur during abnormal operating conditions.

The average value of motor voltage depends on three control variables: the speed selected by the microcomputer which is updated by the Hall effect sensor 104, the back EMF of the motor coming through back EMF amp 106 and the current resistance correction from the peak detector 114. These three signals, which are represented in the schematic of FIG. 6 by the command integrator 99, peak detector 114 and back EMF amp 106, are summed as an input to the error amp 102. As shown in FIG. 5A the error amplifier 102 compares the three feedback signals to a precision voltage reference 117 and regulates the selected speed of the D.C. motor 32.

The compensation network across the error amplifier 102 limits the system band width and provides positive phase margin at unity gain to maintain control loop stability. The frequency response of the control loop is determined by the system band width, which must be significantly greater than the fastest agitation stroke rate to ensure adequate speed regulation over the entire load range. If the band width is too low, then the D.C. motor 32 will speed up and slow down during a single agitation stroke due to torque fluctuations causing decreased clothes rollover performance. If the band width is too great, the control and therefor the agitator 30, may be subject to undue oscillation. Since the desired band width may change from motor to motor, it is recommended that the circuit be modified, through appropriate selection of values for $R_1$ and $C_6$, to achieve desired performance for a given washer design. The output of the error amp 102 is sent to an input 118 of the PWM-IC.

Referring again to FIG. 6 and based on the output of the error amplifier 102, the PWM-IC 110 adjusts the duty cycle of the 20 KHZ pwm, pulse width modulated output. An output 119 of the PWM-IC 110 supplies voltage to a proportional base drive circuit 120 which controls the bipolar switch 108 providing voltage to the D.C. motor 32. The duty cycle of the output will vary between 0% and 95% depending on load, speed, and A.C. line variations in order to maintain good speed regulation.

The PWM-IC 110 accepts an input at 122 from the set back integrator 116 and clamps the duty cycle of the PWM-IC 110 if the current limit is exceeded for a specified time period. In the integrator 116, a capacitor charges to a pre-selected voltage level, protecting the control and motor 32 from overload under abnormal torque requirements.

The motor current wave form through the parallel resistor combination $R_{38}$ and $R_{31}$ is monitored by the PWM-IC 110, which provides pulse by pulse current limiting through a current limit 109 if peak levels are above the specified limit set by the ratio of the parallel set of resistors 124 to the resistor $R_9$.

A precision voltage reference 117 is supplied by the reference buffer amplifier 126. The reference buffer amplifier 126 derives a precision reference voltage using the voltage divider $R_{35}$ and $R_{13}$ in conjunction with diode $D_{20}$. The jumper 129 may be installed to eliminate diode $D_{20}$ to compensate for variations in the voltage output from the PWM-IC into resistor $R_{35}$, which variations arise from production variations in the PWM-IC. This voltage reference 117 is used as an input to the error amp 102 and is compared to the feedback signals, as described above.

A 20 KHZ rectangular wave signal 119 with varying duty cycle is supplied by the PWM-IC and controls a diode 128 and a transistor 130 to thereby control an n-channel MOSFET 134, as shown in FIG. 5B. The more positive portion the waveform of signal 119 saturates the transistor 130 causing a rapid build up cf charge on gate 132, thereby turning on FET 134. The grounded portion of the waveform turns off transistor 130 and draws the charge from the gate 132 of MOSFET 134 through the diode 128. The MOSFET controls the proportional drive transformer circuit 120 by switching on and off at 20 KHZ. A secondary 136 of the transformer is connected to a base 138 of the bipolar transistor switch 108.

There is another one turn winding 140 on the secondary 136 of the transformer 120 which feeds back a proportional amount of motor current controlling how deeply the bipolar transistor 108 is driven into saturation, which depends on the motor load. For a more detailed reference, describing the proportional base drive circuitry, see the Unitrode Applications Handbook, 1986, pages 374–380.

The current from the transformer secondary 136 flows into the base of the bipolar transistor 108, forcing it into saturation and cut off at a 20 KHZ rate. The full-wave rectified line voltage from bridge rectifier $D_{10}$ is chopped at this rate thereby controlling the current supply to the D.C. motor 32.

The fly back diode 105 is required across the motor leads to provide a path for current flow out of the motor 32 when the switching transistor 108 is not conducting. The current through the motor is further switched by the reversing relay K1. When reversing relay K1 is energized by the microcomputer 92, the agitation mode is selected. De-energizing the reversing relay K1 causes the motor to rotate in the spin direction.

A more complete listing of the preferred individual circuit elements as illustrated in FIGS. 5A and 5B is as follows:

| REFERENCE | DESCRIPTION | PART NO. |
|---|---|---|
| U1 | IC SMPS CONTROL | 4555-11-5560 |
| U3 | IC QUAD OP AMP | LM324N |
| U4 | IC QUAD OP AMP | TLC274ACN |
| VR1 | IC VOLTAGE REG 12V | MC7812CT |
| U2 | IC OPTOCOUPLER | 4N25A |
| Q3 | TRANSTR NPN PR 400V 20A | 2N6926 |
| Q4 | TRANSISTOR NCH VFET | MTP3055E |
| Q1 | TRANSISTOR DRIVER NPN | D44C2 |
| Q2 | TRANSISTOR NPN SW | MPSAO5 |
| D1, 3, 4, 5, 6, 7, 13, 19, 20 | DIODE SWITCHING | 1N4148 |
| D2, 8, 9, 12, 18 | DIODE 1A 200 PIV | 1N4003 |
| D14, 16 | DIODE 1A 100 PIV 50 NS | UF4001 |
| D10 | DIODE BRIDGE 25A 400PIV | KBPC2504W |
| D11 | DIODE HISPD 15A 400PIV | FES16GT |
| D15 | DIODE 1A 400V 50NS | UF4004 |
| D17 | DIODE ZENER 39 V 10% 1W | 1N4754 |
| RV1 | MOV | ERZC20DK201U |
| C33 | CAP 100PF 5% 100V CER | CAC02COG101J100A |
| C32, C18 | CAP .001UF 10% 50V X7R | 592CX7R102K050B |
| C2, C7, C15, C17, C19 | CAP .01 UF 20% 100V X7R | C410C103M1R5CA |
| C1, C8, C21, C27, C31, C23, C37 | CAP .1 UF 50V Z5U CER | SA205E10RZAA |
| C25 | CAP 6.8 UF 10% 16V DIP T | ECS-F1CE685KB |
| C26, C29 | CAP 10 UF 20% 35V AL EL | SM35VB10M5X11MT |
| C16 | CAP 47 UF 20% 16V AL EL | SXC16VB47M8X11MT |
| C28 | CAP 68 UF 20% 16V AL EL | LL16VB68M8X11.5CC |
| C30 | CAP 2200 UF 20% 35V AL | SM35VB222M18X35.5CC |
| C4, C34, C35, C36 | CAP 1000 PF 250VAC MET P | PME271Y410 |
| C13 | CAP .0033UF 2% 50V PROP | ECQ-P1H332GZ |
| C22 | CAP .0033 UF 63V STK MYL | IR67323KU |
| C9, C14 | CAP .01UF 10% 400V PROP | X663UW |
| C6, C24 | CAP .01UF 100V 10% MYLR | ECQ-E1103KNB9 |
| C5 | CAP .047 UF 250 VAC MP | PME271M547 |
| C3, C12 | CAP .22UF 250VAC MYLR | QXC-2E224KTP1FY |
| C10 | CAP .47 UF 10% 100V MET | X335 |
| C11 | CAP 10 UF 5% 240VAC MET | ECW-F24106JA |
| R2, R5, R15, R26, R33 | RESISTOR 100 OHM 1/4W 5% | CF |
| R32 | RESISTOR 750 OHM 1/4W 5% | CF |
| R23, R40, R44, R55 | RESISTOR 1K 1/4 W 5% CF | CF |
| R53 | RESISTOR 4.3K 1/4 W 5% CF | CF |
| R14 | RESISTOR 4.7K 1/4W 5% CF | CF |
| R34 | RESISTOR 10K 1/4W 5% CF | CF |
| R36 | RESISTOR 1M 1/4W 5% CF | CF |
| R7, R9 | RESISTOR 1.00K 1/4W 1% MF | RN55D 50PPM |

-continued

| REFERENCE | DESCRIPTION | PART NO. |
|---|---|---|
| R8 | RESISTOR 1.69K 1/4W 1% MF | RN55D 50PPM |
| R17 | RESISTOR 3.01K 1/4W 1% MF | RN55D 50PPM |
| R13 | RESISTOR 3.24K 1/4W 1% MF | RN55D 50PPM |
| R39, R41 | RESISTOR 3.32K 1/4W 1% MF | RN55D 50PPM |
| R35 | RESISTOR 3.40K 1/4W 1% MF | RN55D 50PPM |
| R45 | RESISTOR 5.36K 1/4W 1% MF | RN55D 50PPM |
| R6, R10, R43 | RESISTOR 10.0K 1/4W 1% MF | RN55D 50PPM |
| R21 | RESISTOR 11.0K 1/4W 1% MF | RN55D 50PPM |
| R30 | RESISTOR 16.9K 1/4W 1% MF | RN55D 50PPM |
| R37 | RESISTOR 18.2K 1/4W 1% MF | RN55D 50PPM |
| R3 | RESISTOR 19.1K 1/4W 1% MF | RN55D 50PPM |
| R29, R11 | RESISTOR 20.0K 1/4W 1% MF | RN55D 50PPM |
| R49, R50 | RESISTOR 36.5K 1/4W 1% MF | RN55D 50PPM |
| R19 | RESISTOR 39.2K 1/4 W 1% MF | RN55D 50PPM |
| R25 | RESISTOR 100K 1/4 W 1% MF | RN55D 50PPM |
| R42 | RESISTOR 133K 1/4 W 1% MF | RN55D 50PPM |
| R27 | RESISTOR 301K 1/4 W 1% MF | RN55D 50PPM |
| R46 | RESISTOR 487K 1/4 W 1% MF | RN55D 50PPM |
| R52 | RESISTOR 499K 1/4 W 1% MF | RN55D 50PPM |
| R47, R48 | RESISTOR 1.00M 1/4 W 1% MF | RN55D 50PPM |
| R16, R28 | RESISTOR 2.00M 1/4 W 1% MF | RN55D 50PPM |
| R1 | RESISTOR 4.75M 1/4 W 1% MF | RN55D 50PPM |
| R18 | RESISTOR 12 OHM 1/2 W 5% | CF |
| R22 | RESISTOR 1K 1/2 W 5% CF | CF |
| R51 | RESISTOR 33K 1/2 W 5% CF | CF |
| R31, R38 | RESISTOR .1 OHM 2% or 3% 2 | SPP 2 |
| R4 | RESISTOR 47 OHM 5% 5W WW | PPW-5-47ohm-5% |
| R20 | RESISTOR 130 OHM 5% 2W | FP2130 5% |
| J1 | CONNECTOR 5 PIN MATE&LOCK | 640466-1 |
| J2 | CONNECTOR 3 PIN HEADER | B3P-VH |
| K1 | RELAY DPDT 12DC 13A | LYQ2-O-US |
| T1 | TRANSFORMER BASE DRIVE | 328-0062 |
| T2 | TRANSFORMER PC MT 10VA | 4555-10-016 |
| L1 | CHOKE DRUM CORE, 300 UH | PCV-2-300-10 |
| L5 | CHOKE COMMON MODE | F5806B |
| L2 | CHOKE OUTPUT 10 UHY | PCV-0-010-10 |

Figure 9A:
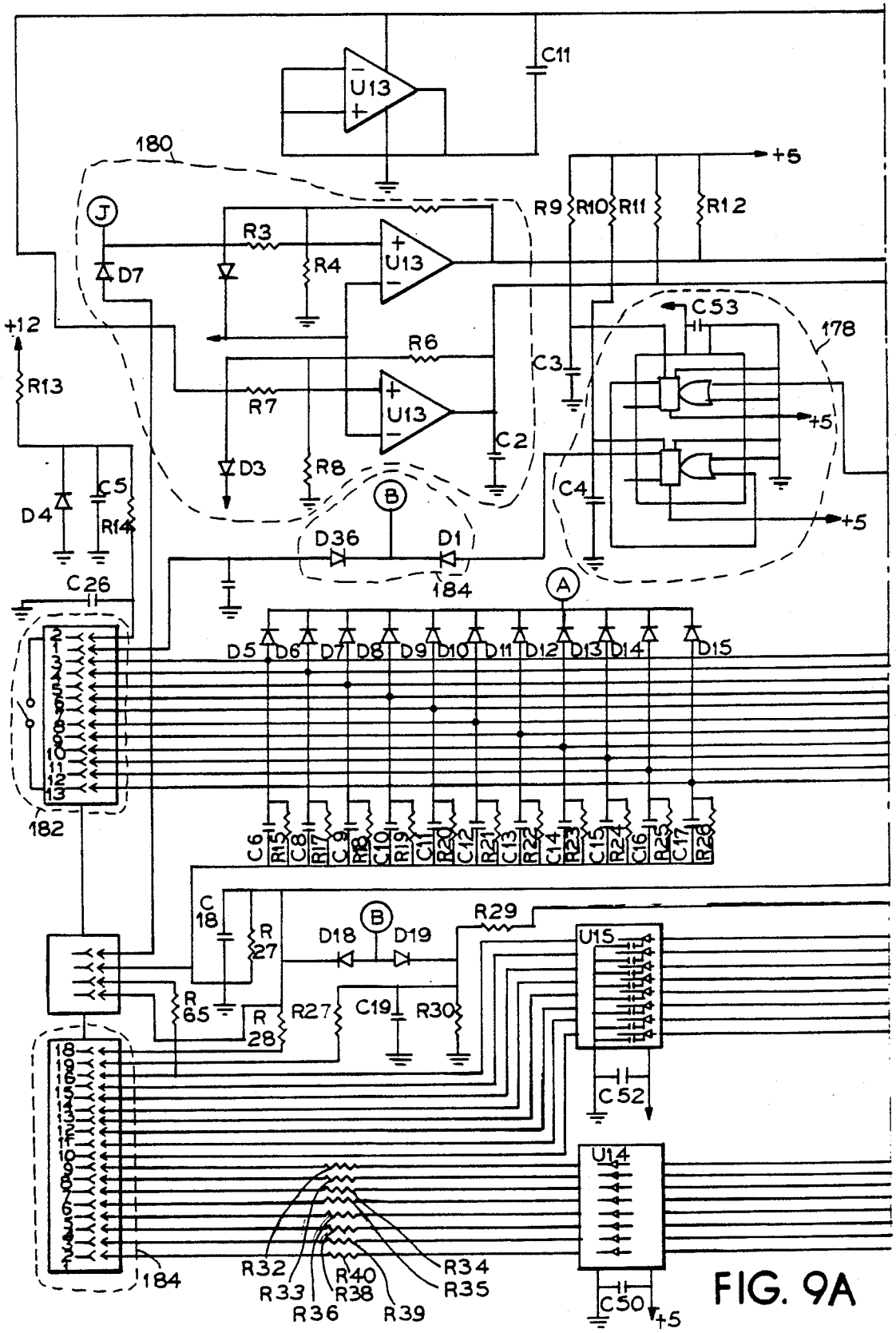
FIGS. 9A, 9B and 9C are detailed electrical schematic diagrams for a processor board used in conjunction with the electronic motor control of FIG. 5.
Figure 9B:
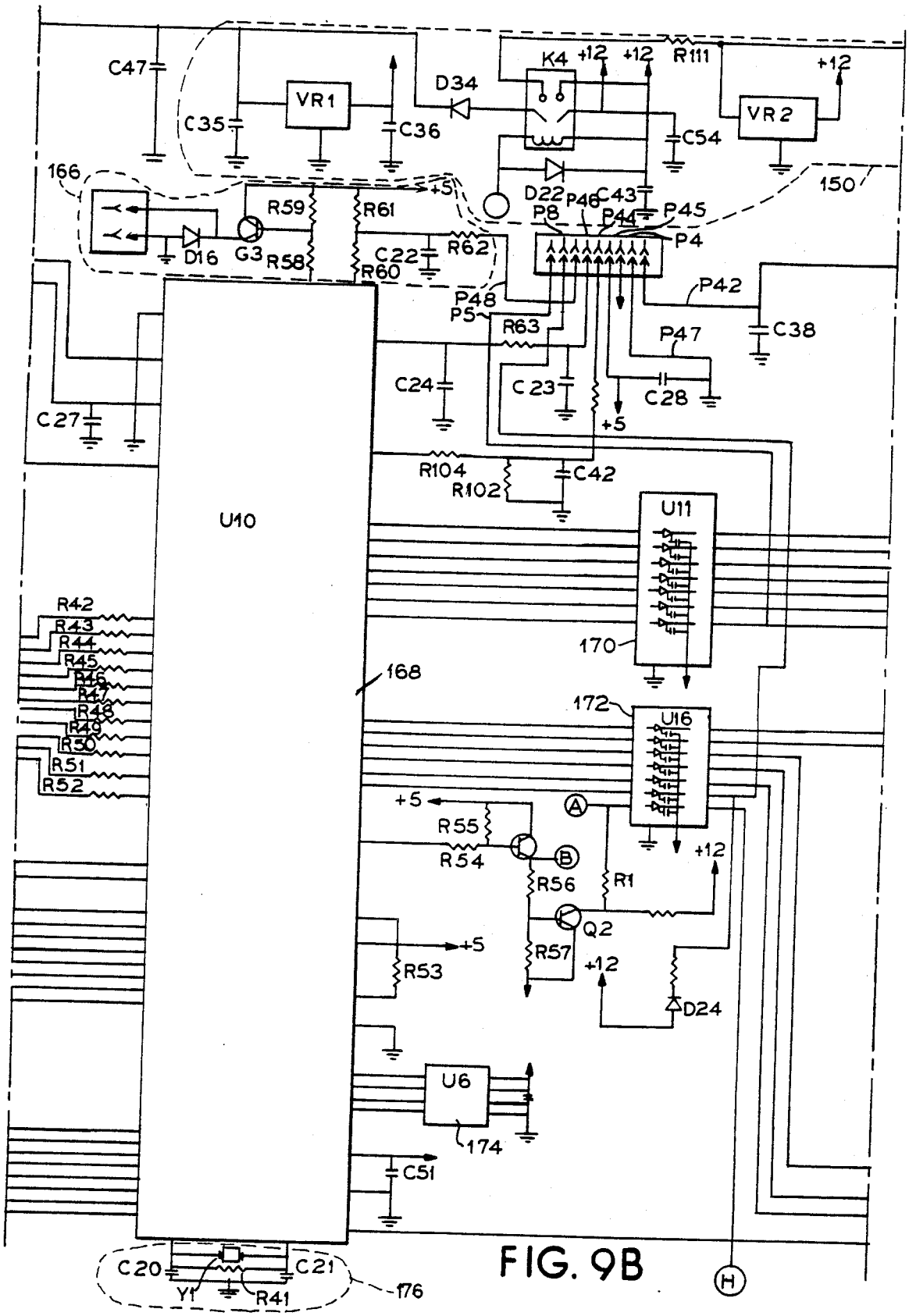
Figure 9C:
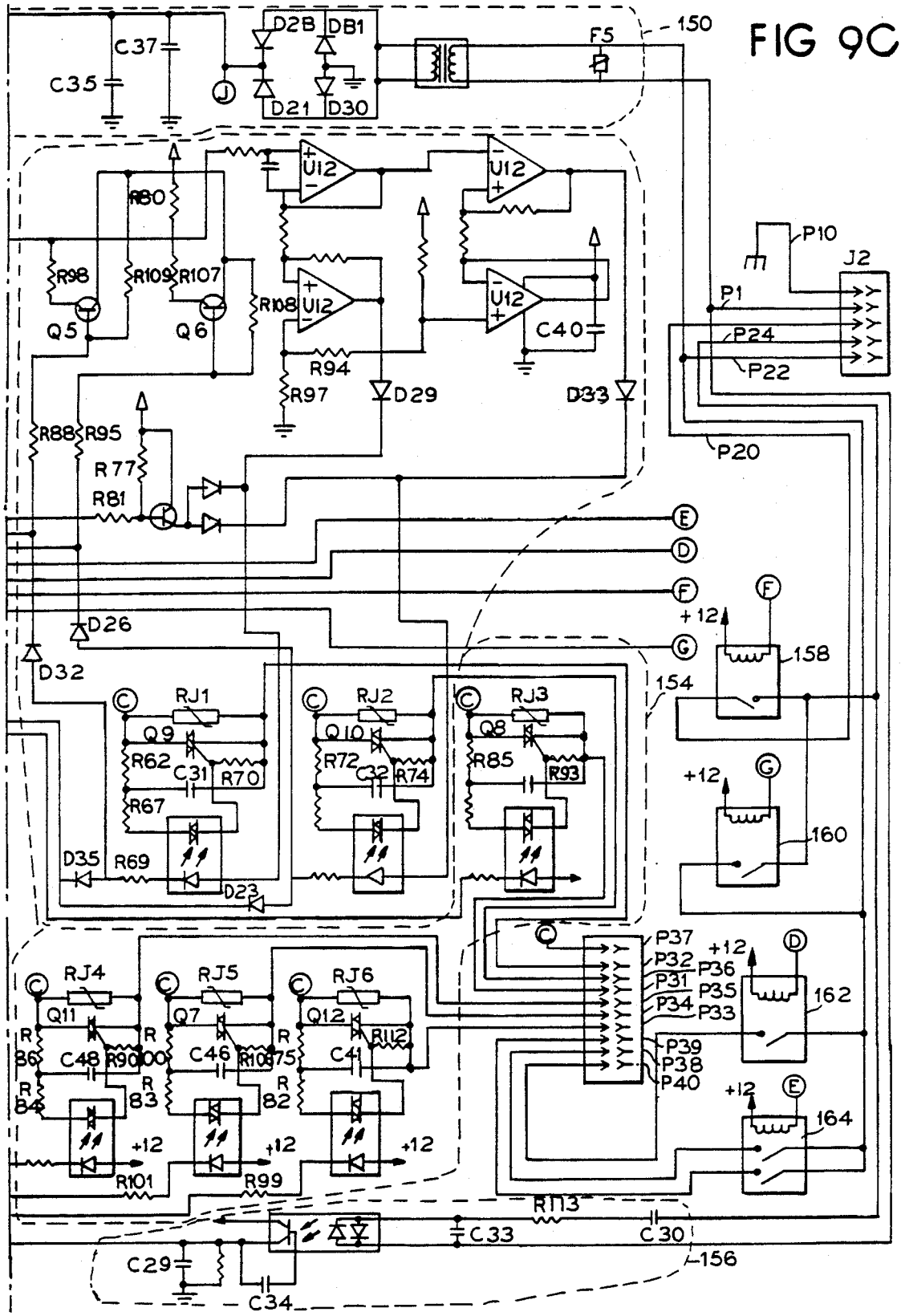

FIGS. 9A, 9B and 9C are detailed electrical schematic diagrams for a processor board to be used in conjunction with the electronic motor control of FIGS. 5A and B. A power supply 150 is shown in FIGS. 9B and 9C. An electronic water temperature control 152 is provided to maintain a selected water temperature as selected by user input of the water temperature selector 22. A dispenser control 154 is provided to appropriately control various dispensers such as detergent dispensers, bleach dispensers and rinse additive dispensers. Lid switch detector circuitry 156 is provided to send appropriate signals upon detection of an open lid condition in order to temporarily terminate motor operation.

Various relays are also provided such as relay 158 which is a motor master relay, relay 160 which is a lid bypass relay, relay 162 which is a pump relay and relay 164 which is a valve and light relay. An output circuit 166 is provided for controlling an external speaker. A microcomputer 168 provides the controlling of the various functions of the control. Output amplifiers 170, 172 are provided to amplify the signals to the various relays and other components. An electrically alterable ROM 174 is provided to permit memory storage during various portions of the wash cycle. Timing circuitry 176 is provided for the microcomputer 168. A watch dog timer circuit 178 is shown in FIG. 9A which prevents a hang up of the control system for a time period greater than a predetermined set time. Power up reset and power down circuitry 180 is provided. Cycle and cancel inputs are provided through input switches 182 and a turn off circuit 184 receives the cancelled signal. Additional key input circuitry is provided at 186.

Figure 10:
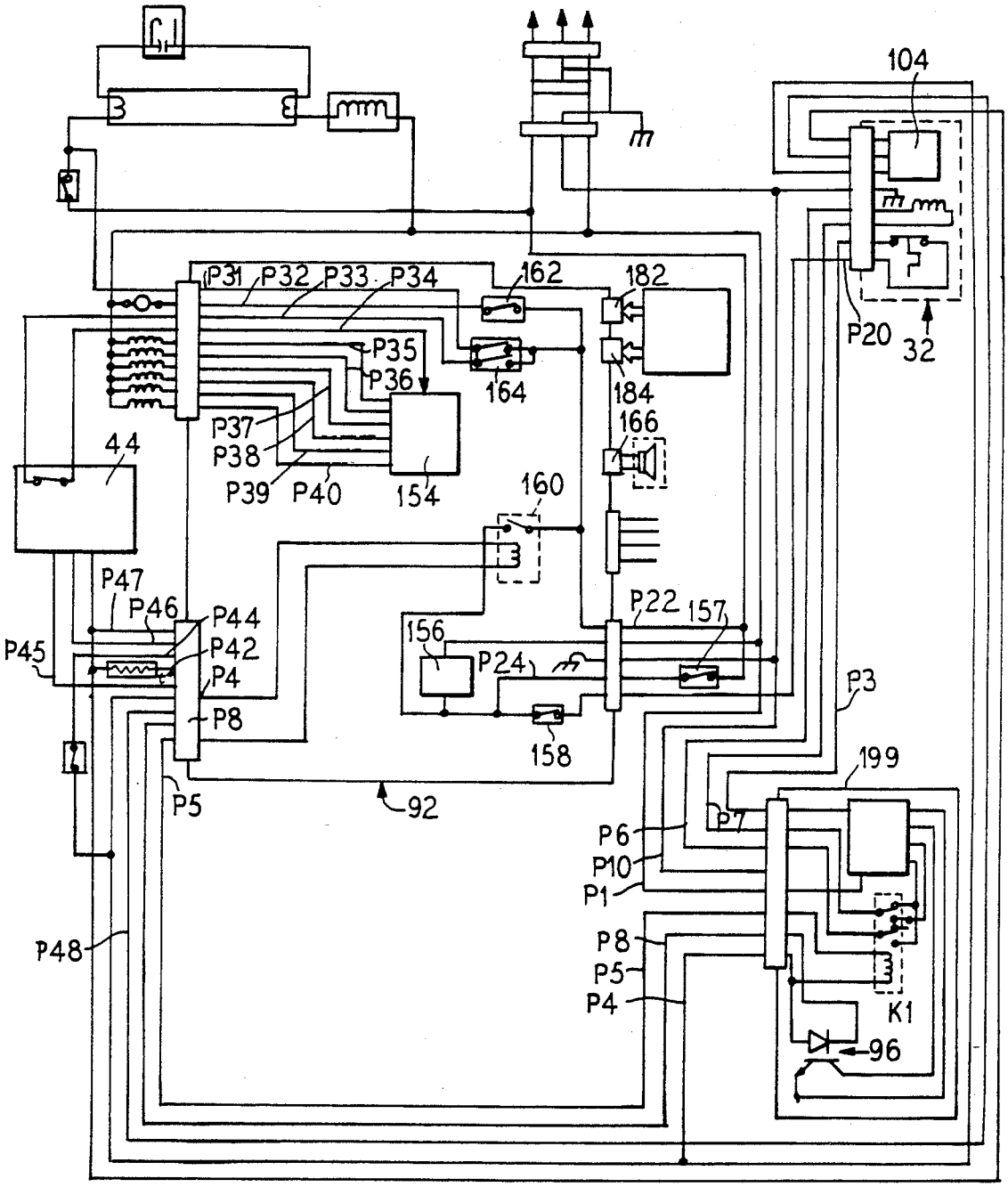
FIG. 10 is an electrical schematic diagram for the overall control including the processor board of FIGS.

FIG. 10 provides an electrical schematic diagram for the control incorporating the motor 32, the water level sensor 44, the lid switch 157 motor control board of FIGS. 5A and 5B, the microcomputer control 92 of FIGS. 9A, 9B and 9C and the control panel 21 of FIG. 7 illustrating the electrical interconnections therebetween, as clarified by the connection charts of FIGS. 8D and 8E.

A more complete listing of the individual circuit elements as illustrated in FIGS. 9A, 9B and 9C is as follows:

| Reference Alphanumeric | Description | Part No. |
|---|---|---|
| U1 | IC MICROPROCESSOR, MASKED | HD63B05Y0 C51 |
| U15 | IC SOURCE DRIVER 8W | UDN2981A |
| U14 | IC SINK DRIVER 8W | UDN2595A |
| U11, 16 | IC SOURCE DRIVER | ULM2003A |
| U13 | IC QUAD COMPARATOR | LM339N |
| U12 | IC QUAD OP AMP | LM324N |
| U2 | IC DUAL MONO MULTIVIB | MC14538BCP |
| VR1 | IC VOLTAGE REG 5V | MC7805CT |
| VR2 | IC VOLTAGE REG 12V | MC7812CT |
| U3 | IC OPTOCOUPLER | H11AA1 |
| U4, 5, 9, 8, 10, 7 | IC OPTOCOUPLED TRIAC | MOC3011 |
| DU6 | IC EEPROM | NMC9306N |
| Q2 | TRANSISTOR NPN SWITCH | MPS2222 |
| Q3 | TRANSISTOR PNP SWITCH | MPSA56 |
| Q1, 4, 5, 6 | TRANSISTOR PNP SWITCH | MPS2907 |
| Q7, 8, 9, 10, 11, 12 | TRIAC 0.6A 400V | MAC97A6 |
| D15, 14, 13, 12, 11, 10, 9, 8, 7, 6, 5, 20, 2, 1, 3, 36, 35, 23, 26, 32, 25, 27, 29, 33, 18, 19, 16 | DIODE SWITCHING | IN4148 |
| D17, 34, 22, 28, 31, 21, 30 | DIODE 1A 200 PIV | IN4003 |
| D4 | DIODE ZNR 4.3V 5% 500 MW | IN5229B |
| RV7 | MOV | ERZC20DK2010 |
| RV1, 2, 6, 3, 4, 5 | MOV | ERZC14DK241U ECV250NR14-3 |
| D24 | LED RED AXIAL DO-35 | LN2G-(TA) |
| Y1 | RESONATOR CER 8 MHZ + − .5% | KBR8.0M |
| C20, 21 | CAP 22 PF 50V 5% CER | 592CCOG220J050B |
| C18, 19 | CAP .001 UF 10% 50V X7R | 592CX7R102K050B |
| C17, 16, 15, 14, 13, 12, 11, 10, 9, 8, 6, 53, 52, 38, 39, 40, 22, 24, 28, 24, 34 | CAP .01 UF 100V X7R CER | C410C103M1R5CA |
| C1, 5, 25, 26, 27, 33, 44, 45, 47, 51, 54 | CAP .1 UF 50V Z5U CER | SA205E104ZAA |
| C3, C4, C29 | CAP 1 UF 20% 50V AL ELE UCC | SM50VB1M5X11MT |
| C43 | CAP 10 UF 20% 35V AL EL UCC | SM35VB10M5X11MT |
| C2 | CAP 22 UF 20% 25V AL EL UCC | SM25VB22M5X11MT |
| C36, 50 | CAP 47 UF 20% 16V AL EL UCC | SM16VB47M6.3X11MT |

-continued

| Reference Alphanumeric | Description | Part No. |
|---|---|---|
| C35, 37 | CAP 2200 UF 20% 35V ALE UCC | SM35VB222M18X35.5C C |
| C23 | CAP .047 UF 10% 50V MLR | ECQ-M1H473KZB |
| C31, 32, 49, 48, 46, 41 | CAP .1 UF 400V MET MYLR | ECQ-E4104KZ |
| C30 | CAP .56 UF 250VAC MLR | ECQ-EE2A564MW |
| R14 | RESISTOR 100 OHM 1/4W 5% | CF |
| R67, 71, 87, 84, 83, 82 | RESISTOR 180 OHM 1/4 W 5% CF | CF |
| R32, 33, 34, 35, 36, 38, 39, 40, 62 | RESISTOR 220 OHM 1/4W 5% | CF |
| R73, R69 | RESISTOR 560 OHM 1/4W 5% CF | CF |
| R110, 89, 91, 101, 99 | RESISTOR 820 OHM 1/4W 5% CF | CF |
| R13 | RESISTOR 1K 1/4W 5% CF | CF |
| R68, 72, 85, 86, 100, 75 | RESISTOR 2.7K 1/4 W 5% CF | CF |
| R53, 1, 56 | RESISTOR 4.7K 1/4 W 5% CF | CF |
| R12 | RESISTOR 5.1K 1/4 W 5% CF | CF |
| R7, 58, 79, 54, 64, 81 | RESISTOR 6.2K 1/4 W 5% CF | CF |
| R4, 8, 70, 74, 109, 88, 95, 108, 96, 93, 90, 106, 112, 27, 30, 61, 63, 104, 66 | RESISTOR 1OK 1/4 W 5% CF | CF |
| R11 | RESISTOR 11K 1/4 W 5% CF | CF |
| R3 | RESISTOR 12K 1/4 W 5% CF | CF |
| R65, 28, 31 | RESISTOR 15K 1/4 W 5% CF | CF |
| R77, 59, 55, 57 | RESISTOR 22K 1/4 W 5% CF | CF |
| R2 | RESISTOR 27K 1/4 W 5% CF | CF |
| R6 | RESISTOR 51K 1/4 W 5% CF | CF |
| R9 | RESISTOR 82K 1/4 W 5% CF | CF |
| R26, 25, 24, 23, 22, 21, 20, 19, 18, 17, 15, 10, 78, 76, 43, 42, 44, 45, 46, 47, 48, 49, 50, 51, 52, 37, 29, 60 | RESISTOR 100K 1/4 W 5% CF | CF |
| R41 | RESISTOR 1M 1/4 W 5% CF | CF |
| R102 | RESISTOR 4.3K 1/4W 5% CF | CF |
| R114 | RESISTOR 4.7M 1/4 W 5% CF | CF |
| R94 | RESISTOR 5.11K 1/4W 1% MF | RN55D 50PPM |
| R92, R105 | RESISTOR 5.49K 1/4 W 1% MF | RN55D 50PPM |
| R107 | RESISTOR 19.6K 1/4W 1% MF | RN55D 50PPM |
| R98 | RESISTOR 39.2K 1/4 W 1% MF | RN55D 50PPM |
| R97, 103 | RESISTOR 47.5K 1/4W 1% MF | RN55D 50PPM |
| R80 | RESISTOR 64.9K 1/4 W 1% MF | RN55D 50PPM |
| R111 | RESISTOR 22 OHM 1/2W 5% CF | CF |
| R113 | RESISTOR 750 OHM 1W 5% CF | CF |
| K4, 3 | RELAY 2FRM A 5A 12VDC OMRON SEALED | G2R2214P-V-US |
| K2, 5, 2 | RELAY MIN 1 FORM A 10A 1OMRON SEALED | G6C-1114P-US |

-continued

| Reference Alphanumeric | Description | Part No. |
|---|---|---|
| | TRANSFORMER PC MT 10VA MULTIPRODUCTS | 4555-10-016 |

A copy of the source code for the microcomputer 168 is set forth in appendix A.

FIG. 11 illustrates a mechanically operable control for selecting agitation speed based on liquid level selection. The control consists of a timer contact 276 to control power to the circuit. A switch 278 to select a high or low water level is in series with the timer contact 276. A high water level switch 286 is in series with the high speed winding 306 of induction motor 304 and a low water level switch 294 is in series with the low speed motor winding 308 of motor 304. Either the high water level pressure switch 286 or the low water level switch 294 is selected by the water level selector 278. The selected water level switch will control the water valve 302 until the pressure switch trips, at which time the selected motor winding will be energized.

Water level selector switch 278 has an arm 280 controlled by the user to select a high or low water level. A high water level is selected by switching the arm 280 to connect with contact 282 The high water level pressure switch 286 has an arm 288 connected to contact 282. Arm 288 is controlled by the diaphragm 287 of the switch. When the water level is below the factory set trip point of the switch, arm 288 is connected to contact 292 which energizes water valve 302. After the water has filled to the trip point, arm 288 is disconnected from contact 292 and connected to contact 290. Due to the pressure on the diaphragm 287, this permits current to flow through contact 290 to energize the high speed motor winding 306.

A low water level is selected and an operation occurs in an extremely similar manner. A low water level is selected by switching the arm 280 to connect with contact 284. The low water level pressure switch 294 has an arm 296 connected to contact 284. Arm 296 is controlled by the diaphragm 295 of the switch. When the water level is below the switches's factory set trip point, arm 296 is connected to contact 300 which energizes water valve 302. After the water has filled to the trip point, arm 296 is disconnected from contact 300 and connected to contact 298. Due to the pressure on the diaphragm 295, this permits current to flow through contact 298 to energize the high speed motor winding 308.

Those skilled in the art will appreciate that increased numbers of windings, switches, and contacts may be chosen if a greater variety of motor speeds is desired. Additionally, the number of valves, controlling mechanisms for those valves, timer contacts, and reversing mechanisms may be added to increase the capabilities of the implementation of this invention.

FIG. 12 illustrates a mechanically operable control for selecting agitation speed based on liquid level selection in a conventional washing machine in which the reversal of the motor 32' causes the machine to switch from agitation to spin. Motor 32' has a high speed winding 264, a low speed winding 263, and a start winding 258. These windings are controlled by the centrifugal switch 257 and the timer contacts 259 as is well known.

Water level switch 247 is a conventional water liquid level switch with the exception of a second cam coupled to knob 253 controlling arm 252 to connect with contact 251 or 254 depending upon the water level switch setting. As is well known in the art, knob 253 couples via a shaft to a cam controlling the mechanical pressure on the diaphragm 249. The diaphragm 249 is also controlled by the water level to switch arm 250 between a contact connected to the water valve 261 when additional water is required and a contact allowing current flow to the timer motor 270 and various windings and devices as selected via the contacts of the timer. When the arm 250 indicates that the set water level has been reached, current is also allowed to flow through timer contact 266 when closed by the timer motor 270 in a fashion not previously practiced. Timer contact 266 is connected to the arm 252 mechanically controlled by the second cam added to the water level switch. If a high water level is chosen, arm 252 connects to contact 251 which is connected to the high speed motor terminal 260 of the centrifugal switch 257 and onward to the high speed motor winding 264. When a low water level is chosen, arm 252 connects to contact 251 which is connected to the low speed motor terminal 256 of the centrifugal switch 25 and onward to the low speed motor winding 263.

Those skilled in the art will appreciate that increased numbers of windings and contacts may be chosen if a greater variety of motor speeds is desired.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art. For example, although the preferred embodiment described above teaches variation of the speed of the agitator in response to the selection of water level, it is within the contemplation of the inventors and the intended scope of the claims appended hereto that other parameters of agitator motion, such as maximum tip speed, stroke rate, stroke velocity profile, agitator advance or recession, dwell time between strokes, and stroke angle, could be varied in response to the selection of water level.

We claim as our invention:

1. An automatic washer including a wash tub for receiving a charge of wash liquid, an electric motor, an agitator driven by said motor, and a control means for varying a parameter of agitator motion, said control means comprising:

means for selecting at least one of a plurality of wash liquid levels for said wash tub and a wash cycle; and means for operating said motor such as to vary said parameter of agitator motion dependent upon said at least one selected liquid level and said selected cycle during an agitate portion of a wash cycle, said means for operating said motor comprising means for storing interrelationships of quantifications of said parameter of motor operation with wash liquid levels and means for determining an appropriate quantification of said parameter dependent, at least in part, on said selected wash liquid level.

2. An automatic washer according to claim 1, wherein said parameter of agitator motion comprises the speed of said agitator, said means for operating said motor varying said speed dependent upon said at least one selected liquid level.

3. An automatic washer according to claim 1, wherein said means for operating said motor further comprises means for storing predetermined motor speeds for various wash liquid levels and means for reading an appropriate motor speed dependent on said selected wash liquid level.

4. An automatic washer according to claim 1, wherein said means for selecting at least one of said wash liquid level and wash cycle comprises a mechanical input switch means.

5. An automatic washer according to claim 4, wherein said means for operating said motor comprises electrical connections between said mechanical input switch and appropriate windings on said motor.

6. An automatic washer according to claim 1, wherein said means for selecting at least one of said wash liquid level and wash cycle comprises an electronic input switch means.

7. An automatic washer according to claim 1, wherein said means for operating said motor comprises a direct electrical connection between said means for selecting and a preselected winding on said motor.

8. An automatic washer according to claim 1, wherein said means for operating said motor comprises means for reading said means for selecting, and means for controlling a parameter of said motor dependent on said reading.

9. An automatic washer according to claim 1, wherein said means for storing interrelationships of quantifications comprise means for storing predetermined quantifications for various wash liquid levels and said means for determining an appropriate qualification comprises means for reading an appropriate qualification of said parameter dependent on said selected wash liquid level.

10. A method of operating an automatic washer having a wash tub for receiving a charge of wash liquid, an electric motor, and an agitator oscillatingly driven by said motor comprising the steps:

selecting a desired liquid level for said wash tub;

filling said wash tub to said selected liquid level; and operating said motor at a speed dependent upon said selected liquid level during an agitate portion of a wash cycle, including the steps of obtaining data relating to the selected liquid level, wherein said step of selecting a desired liquid level comprises manually operating a selector switch; using said obtained data to determine a motor speed dependent, at least in part, on said obtained data; and energizing said motor in a manner so as to operate said motor at an appropriate speed;

and said method further includes the step of repeatedly rechecking the selected liquid level during said agitate portion of said wash cycle.

11. An automatic washer including a wash tub for receiving a charge of wash liquid and a fabric load to be washed, an electric motor, an agitator oscillatingly driven by said motor, and a control means for controlling the operation of said motor and for varying a parameter of operation of said motor, said control means comprising:

selector means manually operable by a user for selecting a wash liquid level for said wash tub and a wash cycle dependent upon the nature of said fabric load;

means for operating said motor at a preselected quantification of said parameter of operation dependent upon said selected liquid level and said selected wash cycle during an agitate portion of said wash cycle; said means for operating said motor comprising electrical connections between said selector means and appropriate windings on said motor.

12. An automatic washer according to claim 11, wherein said means for selecting a wash liquid level and said wash cycle comprises at least one mechanical input switch.

13. An automatic washer according to claim 11, wherein said means for selecting a wash liquid level and said wash cycle comprises a least one electronic input switch.

14. An automatic washer according to claim 11, wherein said means for operating said motor comprises a direct electrical connection between said means for selecting a wash liquid level and a preselected winding on said motor.

15. An automatic washer according to claim 11, wherein said means for operating said motor further comprises means for storing predetermined quantifications of said parameter of motor operation for various wash liquid levels and wash cycles and means for reading an appropriate quantification of said parameter dependent on said selected wash liquid level and wash cycle.

16. An automatic washer including a wash tub for receiving a charge of wash liquid and a fabric load to be washed, an electric motor, an agitator oscillatingly driven by said motor, and a control means for controlling the operation of said motor and for varying a parameter of operation of said motor, said control means comprising:

selector means manually operable by a user for selecting a wash liquid level for said wash tub and a wash cycle dependent upon the nature of said fabric load;

means for operating said motor at a preselected quantification of said parameter of operation dependent upon said selected liquid level and said selected wash cycle during an agitate portion of said wash cycle; said means for operating said motor comprises electrical connections between said selector means and appropriate windings on said motor;

means for operating said motor comprising means for reading said selected wash liquid level and said selected wash cycle and means for controlling the operation of said motor dependent on said reading.

17. An automatic washer including a wash tub for receiving a charge of wash liquid and a fabric load to be washed, an electric motor, an agitator oscillatingly driven by said motor, and a control means for controlling the operation of said motor and for varying a parameter of operation of said motor, said control means comprising:

selector means manually operable by a user for selecting a wash liquid level for said wash tub and a wash cycle dependent upon the nature of said fabric load;

means for operating said motor at a preselected quantification of said parameter of operation dependent upon said selected liquid level and said selected wash cycle during an agitate portion of said wash cycle; said means for operating said motor comprises electrical connections between said selector means and appropriate windings on said motor;

said parameter of motor operation comprising the speed of said motor.

18. An automatic washer according to claim 17, wherein said means for operating said motor comprises means for reading said selected wash liquid level and said selected wash cycle and means for controlling the speed of said motor dependent on said reading.

19. An automatic washer according to claim 17, wherein said means for operating said motor further comprises means for storing predetermined motor speeds for various wash liquid levels and wash cycles and means for reading an appropriate motor speed dependent on said selected wash liquid level and wash cycle.

20. An automatic washer including a wash tub for receiving a charge of wash liquid, an electric motor, and an agitator oscillatingly driven by said motor comprising:

means for selecting a desired liquid level for said wash tub;

means for filling said wash tub to said selected liquid level;

means for operating said motor at a speed dependent upon said selected liquid level during an agitate portion of a wash cycle;

means for reading the selected liquid level;

means for consulting a stored table of predetermined motor speeds for selected liquid levels, and energizing said motor in a manner so as to operate said motor at an appropriate speed.

21. A method of operating an automatic washer having a wash tub for receiving a charge of wash liquid, an electric motor, and an agitator oscillatingly driven by said motor comprising the steps:

selecting a desired liquid level for said wash tub;

filling said wash tub to said selected liquid level; and operating said motor at a speed dependent upon said selected liquid level during an agitate portion of a wash cycle, including the steps of obtaining data relating to the selected liquid level, wherein said step of obtaining data comprises the step of reading the selected liquid level; using said obtained data to determine a motor speed dependent, at least in part, on said obtained data, wherein said step of using said obtained data further comprises consulting a stored table of predetermined motor speeds for selected liquid levels; and energizing said motor in a manner so as to operate said motor at an appropriate speed.

* * * * *